US005183396A

United States Patent [19]

Cook et al.

[11] Patent Number: 5,183,396

[45] Date of Patent: Feb. 2, 1993

[54] DOUBLE ACTING SIMPLEX PLUNGER PUMP

[76] Inventors: James E. Cook, 418 Rice St., Anoka, Minn. 55303; O. Harald S. Eriksen, 6219 Zealand Ave., North Brooklyn Park, Minn. 55428

[21] Appl. No.: 766,323

[22] Filed: Sep. 27, 1991

[51] Int. Cl.[5] ..... F04B 21/02

[52] U.S. Cl. ..... 417/534; 417/415; 417/454; 417/537

[58] Field of Search ..... 417/415, 454, 534, 535, 417/536, 537, 521

[56] References Cited

U.S. PATENT DOCUMENTS 4,436,493 3/1984 Credle, Jr. ..... 417/454

4,978,284 12/1990 Cook et al. ..... 417/534

*Primary Examiner*—Richard A. Bertsch

*Assistant Examiner*—Charles G. Freay

*Attorney, Agent, or Firm*—Roger W. Jensen

[57] ABSTRACT

A double acting simplex plunger pump comprising a pair of unique unitary combined stuffing box and head members pre-assembled with a double ended plunger, the subassembly being sandwiched between the axial end face of a drive motor and a flat surface of a unitary manifold means and further characterized by means including check valve means for aligning and holding the members.

3 Claims, 4 Drawing Sheets

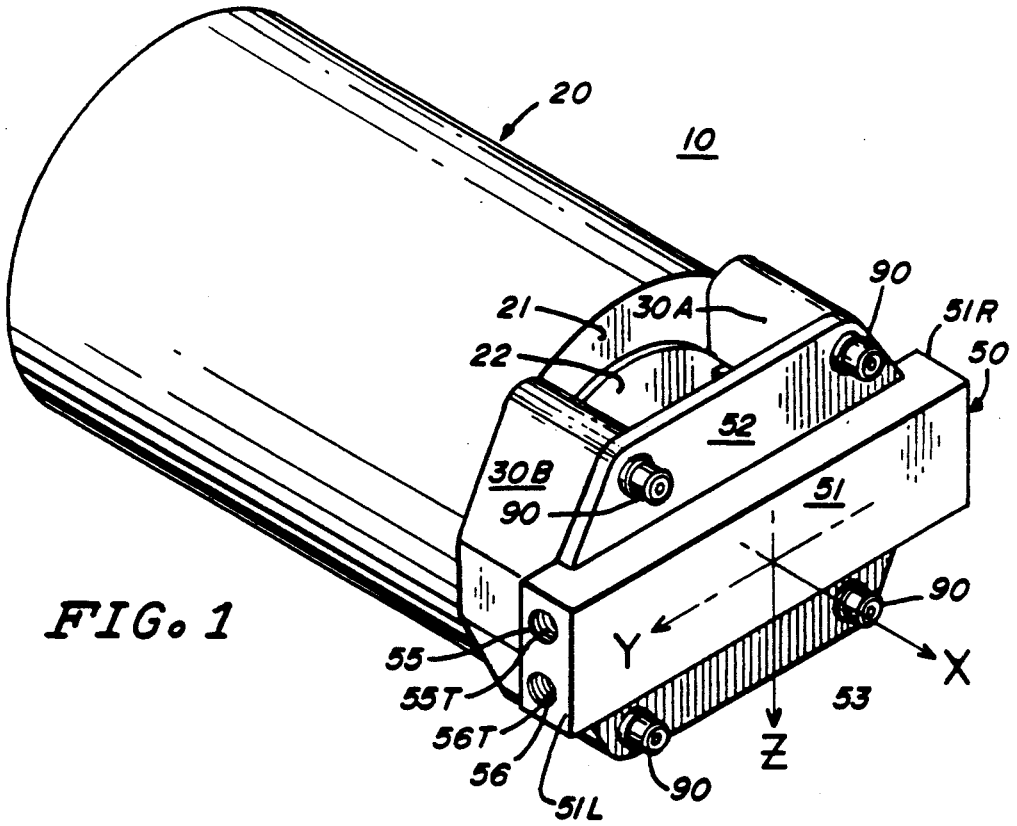
FIG. 1
FIG. 2
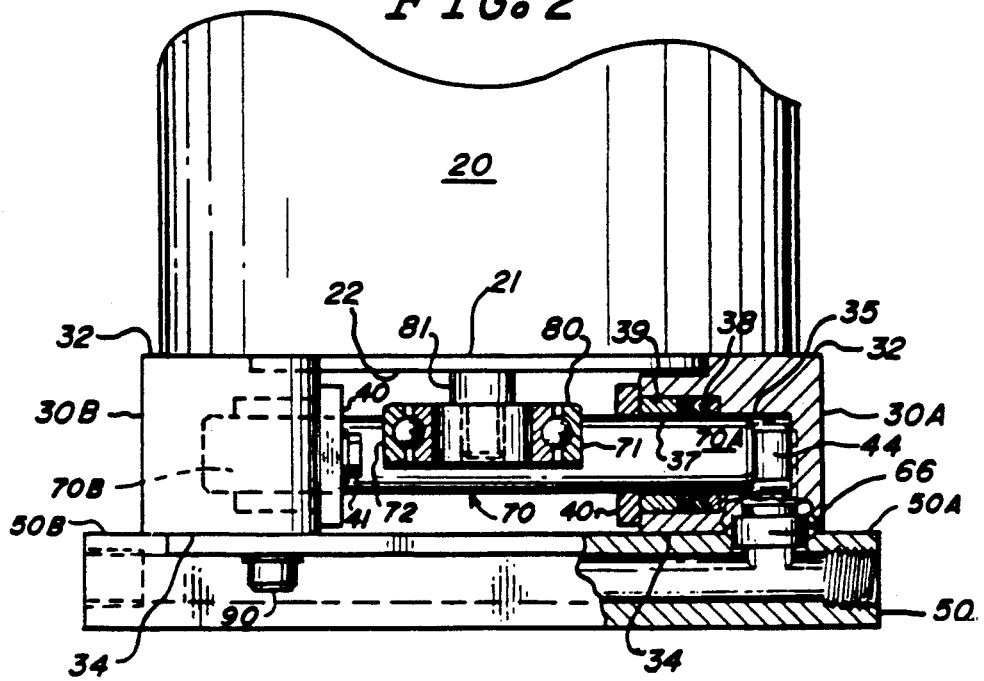

DOUBLE ACTING SIMPLEX PLUNGER PUMP

BACKGROUND OF THE INVENTION

This application covers our invention relating generally to double acting simplex plunger pumps. Our invention specifically is applicable as a modification and improvement of the pump invention described and claimed in the patent application of James E. Cook filed concurrently with this application Ser. No. 07/766,331, and filed Sep. 27, 1991. The aforesaid improvements may generally be described as an improved precision aligning means and an improved structural or holding means for aligning and holding together the individual component parts of the pump.

SUMMARY OF THE INVENTION

The present invention provides an improved double acting simplex plunger pump characterized by having unique alignment and structural means.

DESCRIPTION OF THE DRAWINGS

FIG. 1 is an isometric view of the assembled pump,

FIG. 2 is a view, partly in section, of the pump,

DESCRIPTION OF THE PREFERRED EMBODIMENT

Figure 4:
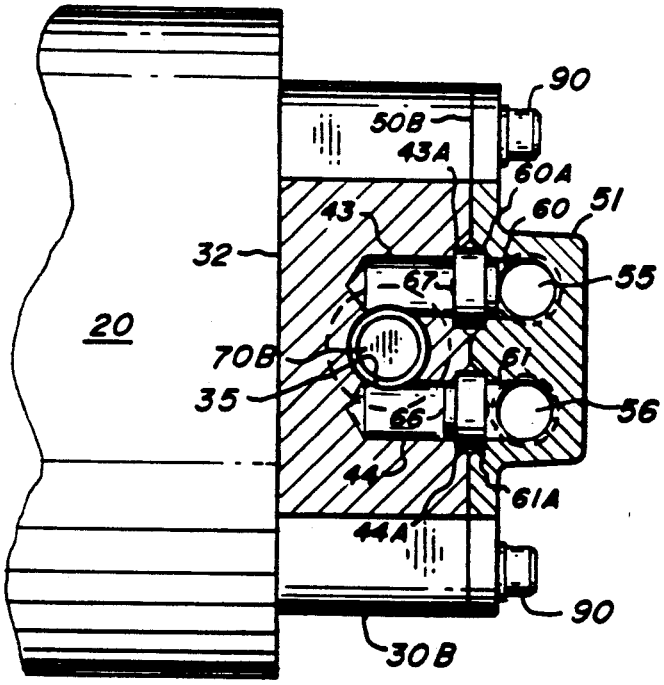
FIG. 4 is a transverse section of the manifold and one of the combined stuffing box and head members.

Referring to FIG. 1, the reference numeral 10 is used to designate the entire improved pump. In broad terms the pump comprises a motor mean 20, a pair of combined stuffing box and head members 30A and 30B, a manifold member 50, and a plunger member 70 (see FIG. 2). FIG. 1 also shows three mutually orthogonal axes X, Y and Z. The X axis is aligned with and/or parallel to the output rotational axis of the motor 20. The Y and Z axes are, for example, representative of the longitudinal axis and one of the transverse axes of the manifold 50. The Y axis is also parallel to the longitudinal or reciprocational axis of the plunger member 70. Further the Y and Z axes define a plane which is parallel to several important surfaces of elements of the pump as will be described below.

Figure 7:
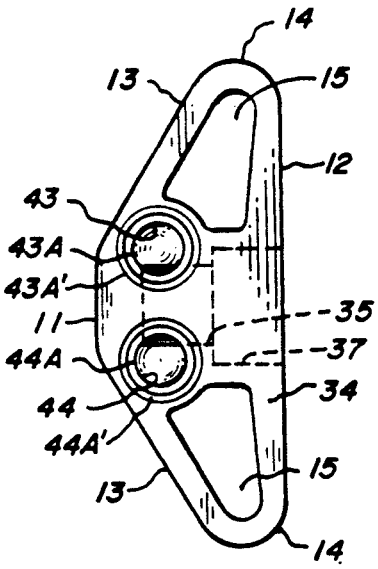
FIGS. 7, 8 and 9 are views of one of the two identical combined stuffing box and head members, FIG. 7 being a view of the side adapted to be in engagement with the manifold, FIG. 8 being a view of the transverse side that includes the plunger receiving recess, and FIG. 9 being a view of the side adapted to the engagement with the motor face.
Figure 8:
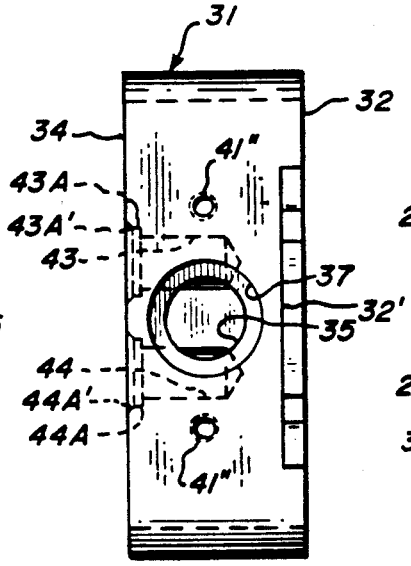
Figure 9:
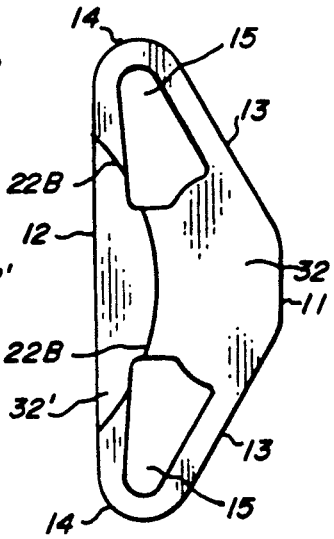

The combined stuffing box and head members 30A and 30B are identical subassemblies having identical piece parts and are arranged, as assembled and as shown in FIGS. 1 and 2, in a reverse or opposite sense as is apparent from the drawings. Each of the combined stuffing box and head members 30A and 30B comprises a unitary block 31, shown most clearly in FIGS. 7-9, having two spaced apart and parallel surfaces 32 and 34, shown best in FIGS. 2 and 8. The flat surface 32 is also designated as a motor end plate engaging surface; the flat surface 34 is designated a pump manifold engaging surface. The unitary block 31, as shown most clearly in FIG. 8, has a constant width between the aforedescribed parallel surfaces 32 and 34. As clearly shown in FIGS. 1, 2 and 3 when the members 30A and 30B are is assembled position, then the parallel surfaces 32 and 34 are also parallel to the aforementioned Y-Z plane and the members 30A and 30B are spaced apart from one another along the longitudinal plunger axis. The other two sides of the block 31, i.e., transverse to sides 32 and 34, and as shown in FIGS. 7 and 9, are defined by the block having a relatively thick center portion bounded by two generally parallel surfaces 11 and 12. Surface 11 is relatively short and surface 12 extends substantially the entire length. A pair of sloping sides 13 extends from the ends of surface 11 in the direction of surface 12. The juncture of surfaces 12 and 13 is a rounded connection designated by reference numeral 14. A pair of large apertures 15 are provided and are shown in FIGS. 7 and 9.

The block 31 is preferably made from an extrusion of a suitable aluminum alloy such as 6061 aluminum with each block being a slice from the extrusion with the flat parallel surfaces 32 and 34 resulting from the slicing process. Thus a basic extrusion is obtained having the aforementioned external surfaces 11, 12, 13 and 14 as well as the large apertures 15. The "slicing" step will be understood by those skilled in the art to include, by way of example, sawing, milling, and grinding.

Each combined stuffing box and head member also includes a deep recess 35 in the block 31 formed by precision boring and extending inwardly from surface 12 (see FIGS. 7 and 8) for receiving one of the ends 70A and 70B of the cylindrically shaped and reciprocating plunger 70, as shown in FIG. 2. The recesses 35 have a circular cross section with a preselected diameter to snuggly receive but not contact the ends 70A and 70B of the plunger. When members 30A and 30B are in the aforesaid assembled position shown in FIGS. 1-3 the longitudinal axes of the recesses 35 of both blocks 31 are in alignment and thus have a common longitudinal axis lying parallel to the reference axis Y and between the spaced apart parallel surfaces 32 and 34. The diameter and the longitudinal length of the recess 35 are preselected to provide the desired pumping performance.

Figure 10:
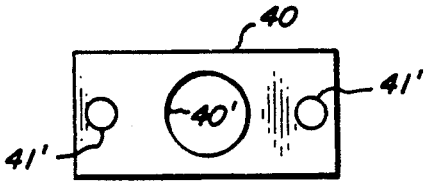
FIG. 10 is a view of the guide and seal retainer.

Each block 31 has an additional plunger guide and stuffing recess 37 concentric with the recess 35 and of a larger diameter for receiving a high pressure seal assembly 38 and a plunger guide or bearing 39. The seal 38 and plunger guide 39 are retained in the assembled relationship shown in FIG. 2 by a rectangularly shaped retainer 40 (see FIG. 10) having a centrally positioned opening 40' for accommodating but not contacting or restraining the reciprocating plunger. The retainer 40 is affixed to the block 31 by suitable attachment means such as machine screws 41 (shown in FIGS. 2 and 3) which pass through apertures 41' of retainer 40 and screw into threaded bores 41'' of block 31 (see FIG. 8).

Each combined stuffing box and head member 30A and 30B further comprises a set of first and second pump port recesses 43 and 44 which start at the pump manifold engaging surface 34 and extend preferably perpendicularly into the block 31 a sufficient preselected distance so as to be in connective relationship with the plunger receiving recess 35, this being shown clearly in FIGS. 4 and 7. Recesses 43 and 44 are shown to have longitudinal axes which are parallel to each other and to the reference axis X. Recesses 43 and 44 further are located symmetrically on opposite sides of the longitudinal axis of recess 35. Additional slightly larger diameter recesses 43A and 44A are provided concentric respectively with recesses 43 and 44 adjacent to surface 34 and provide a seat and one half of a combined enclosure for check valve means to be described below. Also, countersunk or beveled surfaces 43A' and 44A' are provided (as shown in FIG. 8) adjacent to 43A and 44A respectively.

Figure 13:
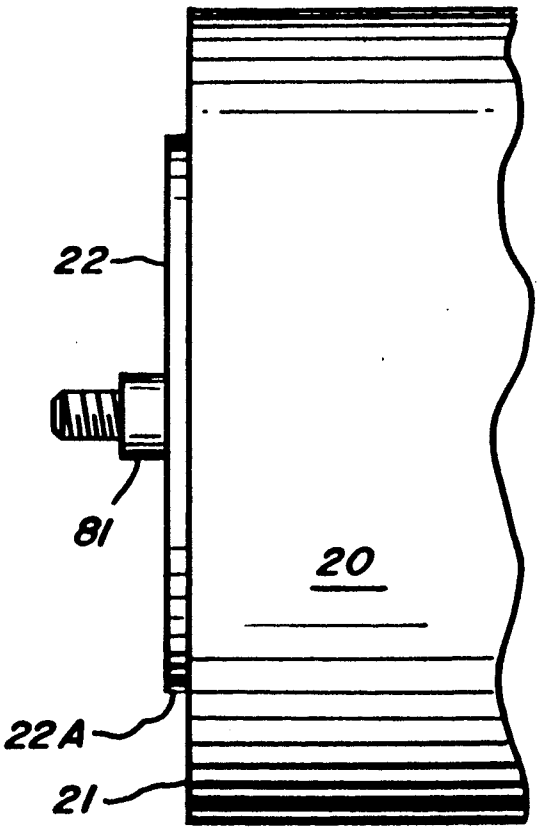
FIG. 13 is a side view of the motor means shown in FIG. 12 with only a portion of the motor depicted.
Figure 12:
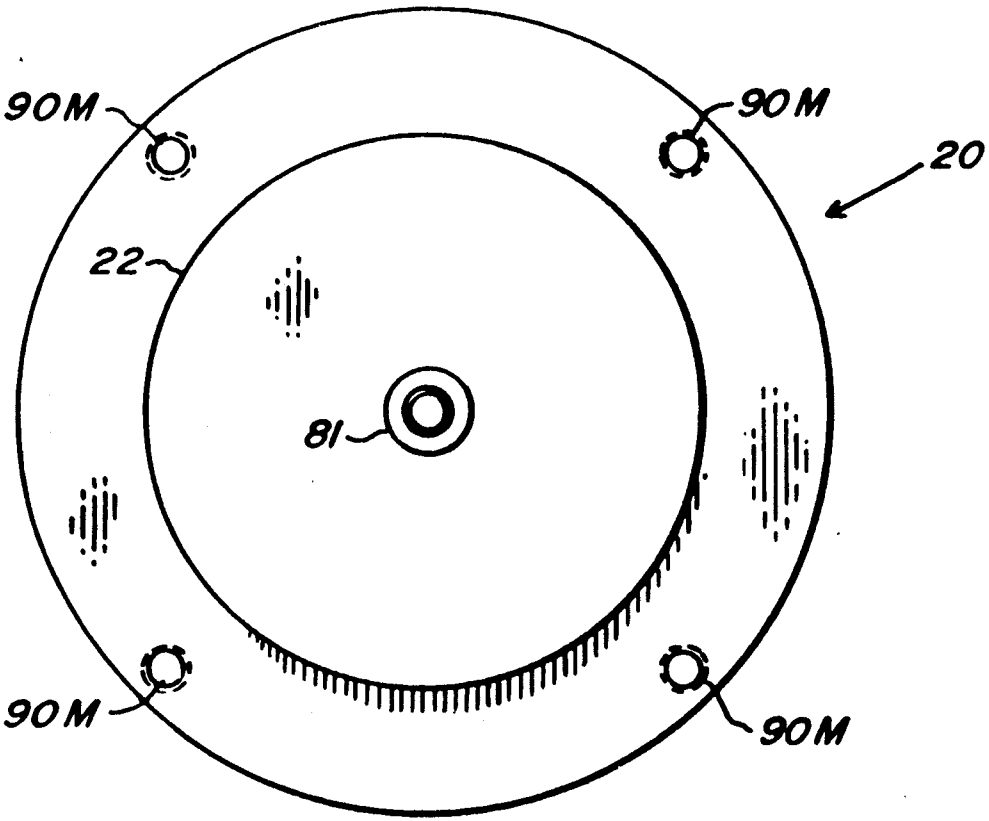
FIG. 12 is an end view of the motor means.

Each block 31 has on surface 32 thereof an arcuate shaped recess providing a flat surface 32' which is parallel to the primary surface 32 and with an arcuate surface 22B selected so as to be of the same radius as 22A of shoulder portion 22 of the motor, as shown in FIGS. 12 and 13.

Figure 5:
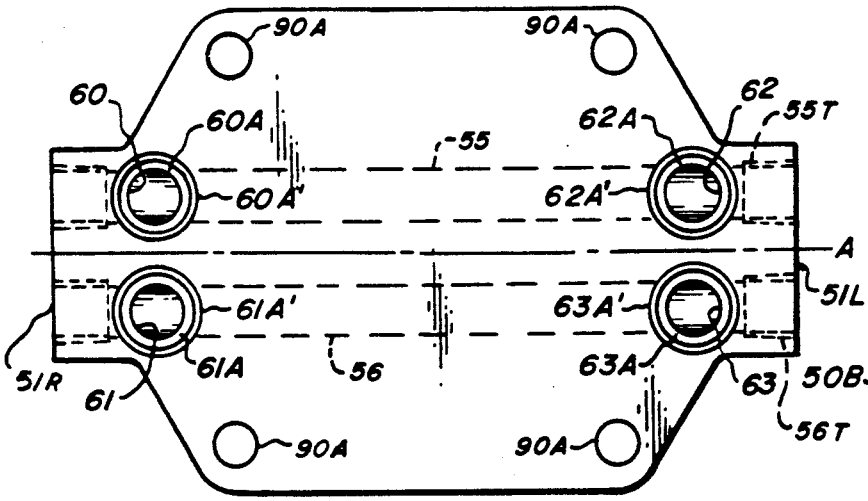
FIGS. 5 and 6 are bottom and end views respectively of the manifold.
Figure 6:
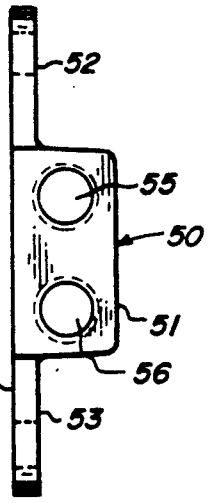

The manifold 50 is a unitary member having a flat rectangular shape with a longitudinal axis A, shown in FIG. 5 and parallel to reference axis Y. The manifold member 50 has a central relatively thick portion 51 extending the full length and a pair of relatively thin flange portions 52 and 53 extending from opposite sides of portion 51 as best shown in FIG. 6. First and second spaced apart manifold inlet/outlet ports 55 and 56 extend longitudinally through the entire central portion 51 from a first end 51L to a second end 51R (see FIGS. 1 and 5). The manifold inlet/outlet ports 55 and 56 are mutually parallel to the manifold longitudinal axis (also reference axis Y) and the ends of the ports 55 and 56 adjacent to ends 51L and 51R are threaded or equivalent as at 55T and 56T to receive appropriate inlet and outlet piping. In practice, there typically would be one inlet and one outlet; in this case the two unused ports would be sealed off with standard plugs. Alternately there could be a double inlet and a double outlet. Additional inlets and outlets may be provided along and perpendicular to ports 55 and 56.

Importantly the manifold member 50 has a bottom flat surface 50B (FIG. 6) which is adapted to be abutted by said pump manifold engaging surfaces 34 of the combined stuffing box and head members 30A and 30B as is best shown in FIGS. 2 and 4. The manifold 50 is preferably made of the same material as block 31 and is formed by an extrusion process whereby the longitudinal ports 55 and 56 are integral with the extrusion, i.e., formed by the extrusion process.

Communicating with the longitudinally extending ports 55 and 56 in the manifold are two sets of transversely extending ports, the first set being adjacent end 51R and identified by reference numerals 60 and 61 (for coaction with pump port recesses 43 and 44 of combined stuffing box and head member 30B). The second set of transversely extending manifold ports are adjacent end 51L and is identified by reference numerals 62 and 63. Port set 62/63 is intended for coaction with the pump port recesses 43 and 44 of combined stuffing box and head member 30A. Port sets 60/61 and 62/63 are preferably provided by a boring or drilling operation and are longitudinally spaced apart a preselected distance so that when the manifold is in an assembled relationship as shown in FIGS. 1–4, each of said sets of ports 60/61 and 62/63 will be in alignment with and in register with a set of pump port recesses 43 and 44 in members 30A and 30B respectively.

Figure 11:
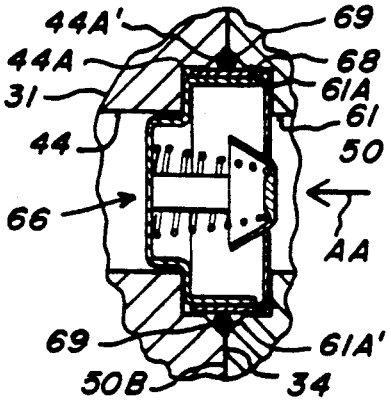
FIG. 11 is a view on an enlarged scale of one of the two identical check valves used in the pump.

The sets of manifold transverse ports 60/61, and 62/63 have associated additional and slightly larger recesses concentric therewith and are identified respectively by reference numerals 60A, 61A, 62A and 63A, these additional recesses are concentric with ports 60–63 respectively and are of a preselected diameter and of an axial depth (together with recesses 43A and 44A) to provide a combined enclosure (see FIG. 4) for check valve means identified by reference numerals 66 and 67. Check valve 66 is shown enlarged in FIG. 11. Check valves 66 and 67 as indicated are identical and are of standard form and function, i.e., they have a cylindrical shape with an outer circumferential surface 68 and of a short axial length. In FIG. 11 the directional arrow AA designates the direction of fluid flow through the check valve means upon a pressure differential being applied across the axial ends of the check valve, as is well understood by those skilled in the art. An O ring 69 is provided encompassing the outer circumferential surface 68.

As indicated, the check valves 66 and 67 are positioned between the manifold and members 30A and 30B in opposite senses as is clearly shown in FIG. 4. As shown, check valve 66 will admit fluid flow from manifold port 56 through check valve 66 and thence, via 44, into plunger recess 35 while check valve 67 permits fluid flow of the reverse sense, i.e., from plunger recess 35 through passageway 43, check valve 67 into manifold port 55.

As indicated above, the manifold recesses 60A, 61A, 62A and 63A in conjunction with the two sets of recesses 43A and 44A of members 30A and 30B provide a combined enclosure for the check valve means 66 and 67. Beveled surfaces 60A', 61A', 62A' and 63A' are provided adjacent recesses 60A–63A respectively and essentially are of the same diameter but of reverse slope of means 43A' and 44A'; Thus, the combined enclosure has a circumferential "V shaped" recess for receiving the O ring 69, as shown best in FIGS. 4 and 11.

The valves 66 and 67 as shown have three very important functions in addition to the valving function as described above; these functions are (i) providing a precision alignment means, (ii) providing a structural or holding means for assisting the holding of the entire assembly together, and (iii) providing an energy absorption all as described below in more detail.

The plunger 70 (see FIGS. 2 and 3) comprises a unitary cylindrical shaft having a preselected longitudinal length with first and second plunger means on the ends thereof; it will be understood that (as shown) the actual pumping function is provided by the snug but noncontacting fit of the plunger shaft into the coacting plunger receiving recess 35 of the combined stuffing box and head. Thus the ends of the plunger member, when the same is reciprocated, provide an alternating pumping action by displacing fluid in the receiving recess 35, i.e., first at one end, e.g., member 30A, and then at the other end, e.g., 30B; hence the designator "double acting". Other or piston configurations may be used with this invention, e.g., see the arrangements depicted in FIGS. 19 and 20 of the aforesaid prior U.S. Pat. No. 4,978,284.

The mid section of the shaft 70 is cut away as is shown in FIG. 2 providing two shoulder-like surfaces 71 and 72 which are adapted to be engaged by a crank eccentric or cam means 80 which is connected to the end of a rotatable shaft 81 of the motor means 20. Cam means 80 is shown in a "12 o'clock position in FIG. 3.

The variation or extent of the eccentric directly varies the pump displacement.

Figure 3:
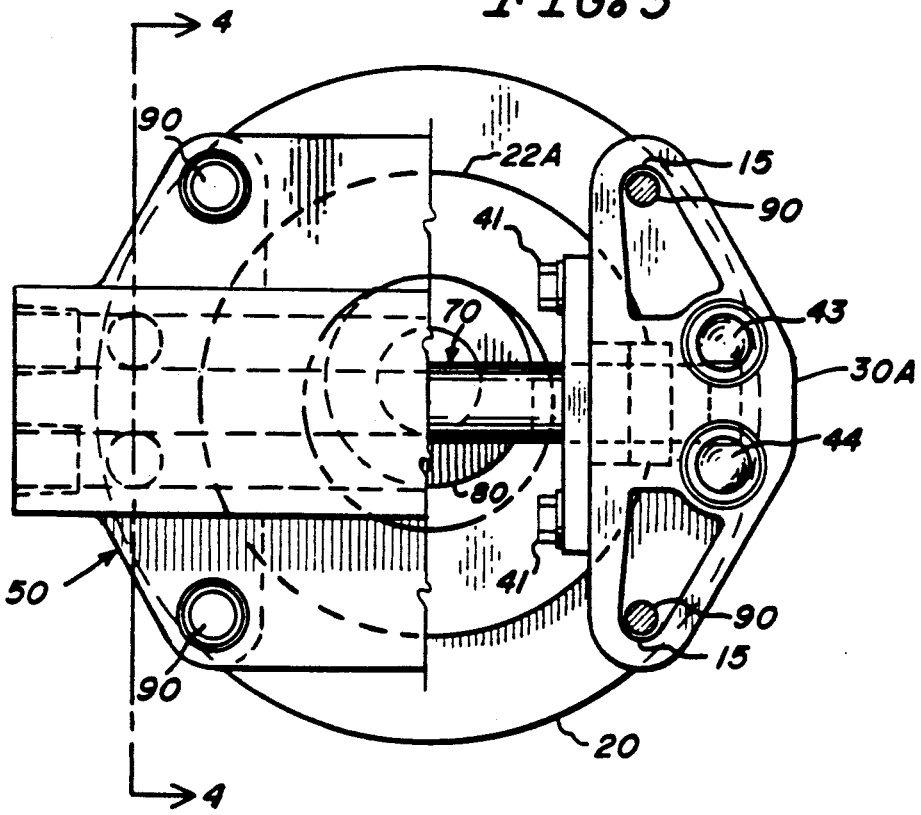
FIG. 3 is an end view, partly in section, of the apparatus shown in FIG. 2, with a portion of the manifold removed.

As shown, motor means 20 is representative of electric motors (A.C. and D.C.) having an output rotatable shaft. However, the invention may be used with other motors such as hydraulic and pneumatic. The motor 20 has a planar axial end face or surface 21 with a central axially extending shoulder portion 22 having a circumferential surface 22A. The rotational axis of shaft 81 is perpendicular to the planar end face 21. The combined stuffing box and head members 30A and 30B are spaced apart as shown in FIGS. 1, 2 and 3 and preassembled with the plunger member 70 and such sub-assembly is then clamped between the planar axial end face 21 of the motor 20 and the manifold 50, as shown clearly in FIG. 2, by having the surfaces 32 in abutting engagement with surface 21 of the motor and by having surfaces 34 in abutting engagement with manifold planar surface 50B. During said assembly, the arcuate surfaces 22B coact with the circumferential surface 22A of the shoulder 22 of the motor 20. Thus, planar surfaces 32' of 30A and 30B will be abutting against portions of the planar axial end surface 21 and arcuate surfaces 22B of 30A and 30B will be abutting against portions of the circumferential surface 22A.

Means are provided to absorb the energy of the reciprocation of the plunger 70, i.e., (i) the clamping of members 30A and 30B (at arcuate surfaces 22B thereof) against the arcuate surface 22A of shoulder portion 22 of motor means 20, and (ii) the aforedescribed linkage of manifold 50, members 30A and 30B, check valves 66 and 67, and the motor means. Further the check valves 66 and 67, per se, act or function as energy absorbers.

As indicated, one category of motor means which may be used as an element of the invention is an electric motor of the type commercially available in numerous sizes and power ratings from several different suppliers; such motors usually have a shoulder means similar to shoulder 22 and the arcuate surface corresponding to 22A of such motors are usually held to close, low or small tolerances in order to meet customer requirements. This invention takes advantage of said low tolerance of surface 22A by using this surface as the reference for the pump design, regard being given to the clamping of arcuate surfaces 22B of members 30A and 30B against surface 22A all as aforesaid.

While the preferred embodiment of the invention using the contact or engagement of (i) surface 22A with surface 22B and (ii) surface 21 with surface 32, the scope of the invention includes, if desired, an engagement or contact of surface 22 of the motor means with surface 32' of members 30A and 30B in addition to or in place of the engagement of surfaces 21/32.

The members 30A and 30B are key to the unique construction of the invention of said copending application of James E. Cook. By having the members constructed from identical blocks 31 (and with surfaces 32 thereof abutting surface 21 of the motor means) with the axes of recesses 35 and the end surfaces 32 and 34 being mutually parallel, (and also parallel to the Y-Z plane) then a first very important criteria is satisfied, i.e., the longitudinal axes of the two recesses 35 are parallel to the planar surface 21 of the motor means 20.

The next key construction feature is that the members 30A and 30B are oriented with respect to each other so that the aforesaid longitudinal axes of the recesses 35 are in precise alignment; the resultant common axis thus defines the reciprocational or longitudinal axis for the plunger 70. The present invention provides an improved means for aligning the axes of recesses 35 as follows. The recesses 43/43A and 44/44A of the members 30A and 30B and the recesses 60/60A and 62/62A of the manifold are bored (or equivalent) using precision procedures. Upon the insertion of the check vlave means into the "combined enclosures" defined by the said recesses upon assembly of the pump the members 30A and 30B will be automatically oriented with respect to the reference "X" axis so that the aforesaid alignment is achieved. The outer circumferential surface 68 of the check valves is preselected so that the check valves snugly fit within the "combined enclosure" to assure the desired degree of alignment.

Thus the present invention provides an advantageous complement to the pump claimed in said copending application of James E. Cook wherein the unique members 30A and 30B with parallel surfaces 30 and 32 function, upon assembly, to automatically position the aforesaid longitudinal axes of said recesses 35 in a plane (parallel to the Y-Z reference plane) which is parallel to the end face 21 of the motor means. The present invention provides an effective and low cost means for having said longitudinal axis in alignment, a pre-requisite for receiving the plunger and long term operation of the pump.

The present invention also provides a means to hold members 30A and 30B from moving away from one another along the plunger axis as a reaction to the force of the reciprocating plunger moving into the recesses 35; said means, in broad terms, includes the manifold and, in general, a connection between the manifold, the members 30A and 30B and the motor means. The specific holding arrangement depicted is for a preferred embodiment of this invention and includes the manifold being connected to (i) members 30A and 30B as aforesaid, i.e., the two sets of check valves 66 and 67 residing in the combined enclosures, and (ii) the motor end face by four machine screws 90 having head means abutting the outboard surfaces of flanges 52 and 53 of the manifold and extending parallel to the reference axis X through apertures 15 of the combined stuffing box and head members 30A and 30B and into appropriate threaded recesses 90M in the axial end face 21 of the motor 20. Thus the check valves residing in the combined enclosure, as aforesaid, provide a strong structural linkage between the manifold and the members 30A and 30B; said linkage thus prevents any "outboard" travel of the members 30A and 30B, i.e., travel along the longitudinal axis of the plunger away from the motor axis.

In summary, the check valves, positioned as aforesaid, provide three important functions energy absorption and of facilitating the alignment and holding of the members 30A and 30B.

It is to be understood that the embodiment of our invention shown is only for the purpose of illustration and that our invention is limited solely by the scope of the appended claims.

We claim as our invention:

1. A double acting simplex plunger pump comprising:

a) first and second unitary combined stuffing box and head members each member comprising (i) a unitary block having two spaced apart and parallel surfaces respectively designated a motor end face engaging surface and a pump manifold engaging surface, (ii) a recess in said block for receiving a cylindrically shaped plunger, said recess having a circular cross section and a longitudinal axis lying parallel to and in between said spaced apart parallel surfaces, (iii) a set of first and second pump port recesses in said block and each extending from said pump manifold engaging surface into said block and into connective relationship with said plunger receiving recess, and (iv) first and second check valve means respectively and reversely positioned in said first and second pump port recesses so that said first check valve means will admit fluid flow from said plunger recess and so that said second check valve means will admit fluid flow toward said plunger recess, b) a manifold having a longitudinal axis, a bottom flat surface adapted to be abutted by said pump manifold engaging surfaces, first and second transversely spaced apart manifold inlet/outlet ports extending longitudinally therethrough from a first end to a second end and being mutually parallel to said longitudinal axis, and first and second longitudinally spaced apart sets of ports connecting said manifold inlet/outlet ports to said bottom flat surface, c) plunger means comprising a shaft having a longitudinal axis and a preselected longitudinal length, first and second pumping means on the ends thereof, and a centrally located crank engaging means, d) motor means having a planar axial end face, an output shaft rotatable about a shaft axis and extending axially from and perpendicular to said end face, and crank means on an end of said shaft, and e) means connecting said members, said manifold, said plunger and said motor means, whereby: (i) said members are preassembled with said plunger means with said first and second pumping means of said plunger means being disposed in said plunger receiving recesses, (ii) said members are spaced apart along said plunger longitudinal axis a preselected longitudinal length, (iii) said motor end face engaging surfaces of said members are abutting said planar axial end face of said motor means, (iv) said pump manifold engaging surfaces of said members are abutting said bottom flat surface of said manifold, (v) said two sets of first and second pump port recesses of said members are respectively in register with said first and second longitudinally spaced apart sets of ports in said manifold, (vi) said check valve means are positioned partially in said sets of first and second pump port recesses of said members and partially in said longitudinally spaced apart sets of ports in said manifold and (vii) said crank means is operatively connected to said crank engaging means of said plunger means, whereby said check valves, positioned as aforesaid, provide structural linkages between said manifold and said members to thereby (a) restrain said member against movement thereby along said plunger longitudinal axis, and (b) provide a precision alignment and positioning of said members with respect to said planar axial end face of said motor means to assure that said longitudinal axes of said members are in mutual alignment to thereby accommodate and hold said plunger means so that the plunger longitudinal axis is perpendicular to said motor output axis.

2. Apparatus of claim 1 further characterized by:

a) said members having additional slightly larger diameter recesses concentric with each said set of first and second pump port recesses and extending a preselected distance from said pump manifold engaging surface into said block, and b) said manifold having additional slightly larger diameter recesses concentric with said first and second longitudinally spaced apart sets of ports and extending a preselected distance from said bottom flat surface into said manifold, whereby said additional recesses provide combined enclosure means within which said check valve means are positioned.

3. Apparatus of claims 1 or 2 further characterized by said check valves functioning to absorb vibrational energy associated with mechanical forces along axes parallel to said manifold longitudinal axis.

* * * * *